US005140923A

United States Patent [19]

Wood

[11] Patent Number: 5,140,923

[45] Date of Patent: Aug. 25, 1992

[54] RAISING AND LOWERING DEVICE

[76] Inventor: Kevin L. Wood, P.O. Box 62, West Linn, Oreg. 97068

[21] Appl. No.: 675,532

[22] Filed: Mar. 25, 1991

[51] Int. Cl.[5] ..... B63C 1/06

[52] U.S. Cl. ..... 114/48; 414/137.7

[58] Field of Search ..... 114/44, 50, 51, 344, 114/365, 366, 259, 48; 401/1-3, 7, 221; 254/45, 47, 89 R; 104/127; 187/95; 414/592, 631, 137.1, 137.7, 678

[56] References Cited

U.S. PATENT DOCUMENTS

| | | | |
|---|---|---|---|
| 1,771,372 | 7/1930 | Bournier | 114/44 |
| 1,804,945 | 5/1931 | Miller | 414/137.7 |
| 1,902,972 | 3/1933 | Rouse | 414/137.7 |
| 1,935,030 | 11/1933 | Hyland | 114/44 |
| 2,045,533 | 6/1936 | Smaltz | 414/137.7 |
| 3,045,839 | 7/1962 | Hibberd | 114/44 |
| 3,262,585 | 7/1966 | Olson | 414/137.7 |
| 3,777,691 | 12/1973 | Beale | 114/48 |
| 3,993,011 | 11/1976 | Garland | 414/137.7 |
| 4,271,553 | 6/1981 | Korsvik | 114/44 |
| 4,627,377 | 12/1986 | Zoonens | 114/373 |
| 4,641,996 | 2/1987 | Seal | 405/2 |
| 4,686,920 | 8/1987 | Thomas | 114/48 |
| 4,697,533 | 10/1987 | Bordreuil et al. | 114/44 |
| 4,708,081 | 11/1987 | Amirikian | 114/230 |
| 4,832,210 | 5/1989 | Wood, II | 212/200 |
| 4,864,951 | 9/1989 | Koepp, Jr. | 114/44 |
| 4,878,450 | 11/1989 | Schmidt, Jr. | 114/259 |
| 4,900,187 | 2/1990 | Uchida et al. | 405/3 |
| 4,976,211 | 12/1990 | Reinhardt | 114/44 |

*Primary Examiner*—Joseph F. Peters, Jr.
*Assistant Examiner*—Clifford T. Bartz
*Attorney, Agent, or Firm*—Kolisch, Hartwell, Dickinson, McCormack & Heuser

[57] ABSTRACT

A raising and lowering device is provided which may be mounted on a reference structure having a mounting surface. The raising and lowering device includes a pair of guide columns, each guide column having a load bearing mount fixedly secured thereto. A load bearing surface on each load bearing mount abuts the mounting surface on the reference structure. Each guide column also defines a cavity and a slot allowing access to the cavity.

A support structure which bears the objects to be raised or lowered extends through the slots and into the cavity of each guide column. Roller assemblies, coupled to the support structure, are positioned within the cavity of each guide column to direct movement of the support structure along the guide columns. Cables connect to the support structure at one end and to a cable joint at the other end. The cable joint is movable using a single actuator, the support structure being evenly raised and lowered thereby.

8 Claims, 3 Drawing Sheets

RAISING AND LOWERING DEVICE

TECHNICAL FIELD

The present invention relates generally to a device which raises and lowers objects between a reference structure and water adjacent thereto. More particularly, the invention relates to a device which is mounted on a boat to raise and lower a dinghy between the boat and the adjacent water.

BACKGROUND ART

There are currently a variety of devices which are available to raise and lower objects between a reference structure such as a ship or a dock and water adjacent thereto. These devices are usually large and often involve complicated structures. As such, known raising and lowering devices are generally unsuitable for use on most smaller boats.

Smaller boats, however, often do require the use of a raising and lowering device. Dinghies, for example, must often be raised and lowered between smaller boats and the adjacent water. Water-related recreational equipment and swimmers may also be raised and lowered between smaller boats and the adjacent water.

Many of the presently available raising and lowering devices employ cables to hold a support structure. In such devices, the support structure bears the object to be raised or lowered. When raising or lowering unbalanced loads with presently available devices, however, problems are often encountered. Where the cables are each raised and lowered by an independent actuator, for example, objects may be raised or lowered non-uniformly. This could, in turn, result in damage to the load or even to the raising and lowering device.

It is therefore intended that this invention provide an improved raising and lowering device which is adapted for use on smaller boats to uniformly raise and lower both balanced and unbalanced loads.

DISCLOSURE OF THE INVENTION

A raising and lowering device is provided which may be mounted on a reference structure having a mounting surface. The raising and lowering device includes a pair of guide columns, each guide column having a load bearing mount fixedly secured thereto. A load bearing surface on each load bearing mount abuts the mounting surface on the reference structure. Each guide column also defines a cavity and a slot allowing access to the cavity.

A support structure which bears the objects to be raised or lowered extends through the slots and into the cavity of each guide column. Roller assemblies, coupled to the support structure, are positioned within the cavity of each guide column to direct movement of the support structure along the guide columns. Cables connect to the support structure at one end and to a cable joint at the other end. The cable joint is movable using a single actuator, the support structure being evenly raised and lowered thereby.

DETAILED DESCRIPTION AND BEST MODE FOR CARRYING OUT THE INVENTION

Figure 1:
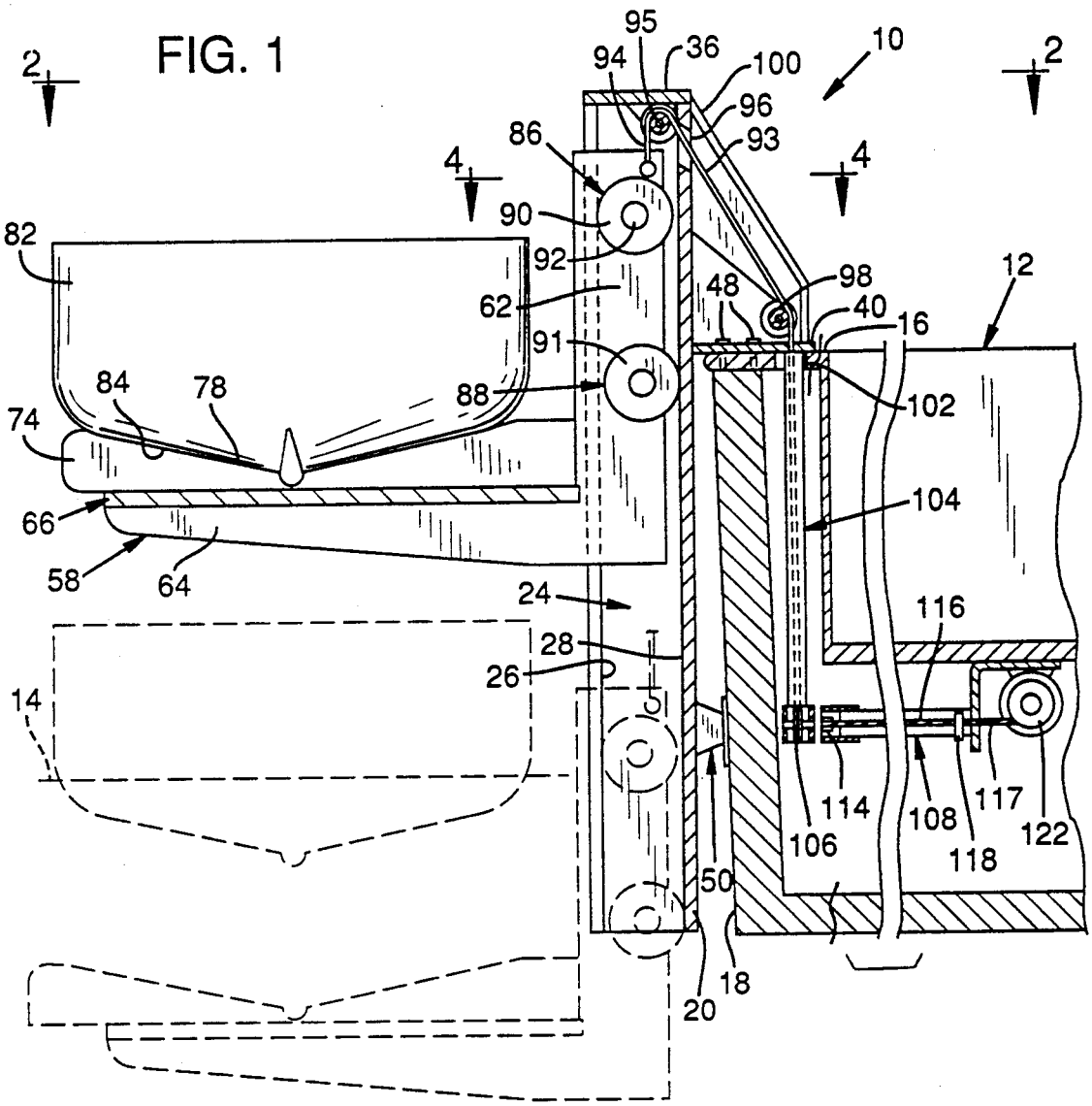
FIG. 1 is a side sectional view of a preferred embodiment of the invented raising and lowering device mounted on a reference structure, the view taken along line 1—1 of FIG. 2.

As stated above, the present invention relates to a device which may be used to raise objects from the water and lower objects to the water. The device is suitable for a variety of uses, but is particularly useful on boats for raising and lowering dinghies.

A preferred embodiment of the invented raising and lowering device has been depicted in the drawings, the device being generally indicated at 10. Device 10 includes a pair of spaced-apart guide columns 20 and 22. As shown, best in FIGS. 1 and 4, each guide column defines a cavity 24, the cavity having a first surface portion 26 and an opposite surface portion 28. Surface portions 26 and 28 at least partially define the boundaries of cavity 24.

Guide columns 20 and 22 may be in the form of square tubes as shown, but it is to be understood that any guide column which defines a cavity with facing surface portions may be used. It is also to be understood that although the depicted embodiment shows only two guide columns, the number of guide columns used may vary with the particular requirements of the raising and lowering device. One, two, three or more guide columns may be used in the present invention.

Figure 4:
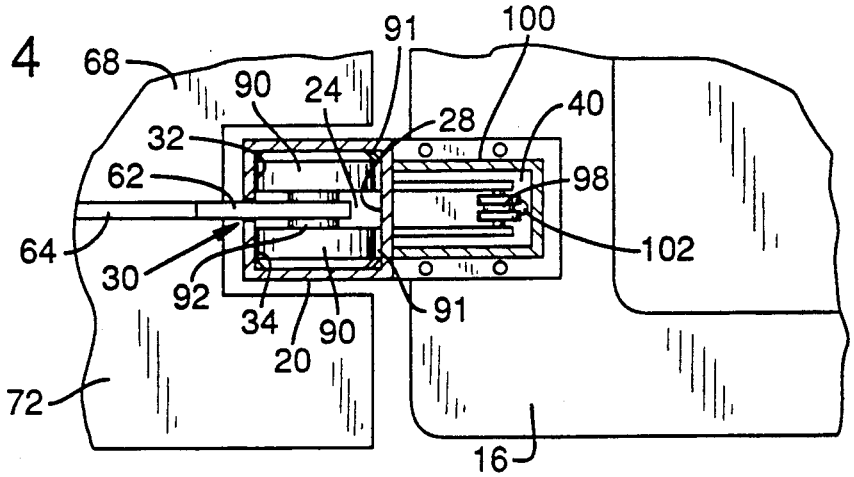
FIG. 4 is a top sectional view of one of the guide columns of the raising and lowering device of FIG. 1.

Each guide column also defines a longitudinal slot 30 which extends along the guide column's length. The slot provides access to cavity 24. As shown in FIG. 4, slot 30 may divide the first surface portion into two sections 32 and 34, each section facing opposite surface portion 28. Top plates 36 and 38 close off the upper ends, but the lower ends of the guide columns remain open to provide drainage from cavity 24.

As shown in FIG. 1, device 10 may be mounted on a reference structure 12, the reference structure being adjacent to a body of water, the surface of which is represented by dashed line 14. Although reference structure 12 will most commonly be a boat, a variety of other structures may be used. Device 10, for example, may also be mounted on a dock or on a pier.

As shown, reference structure 12 includes a mounting surface 16, the mounting surface bearing the weight of device 10. Where the reference structure is a boat, the mounting surface will commonly be the boat's transom. Alternatively, where a dock or a pier acts as the reference structure, the edge of the dock or pier will most likely act as the mounting surface.

Figure 3:
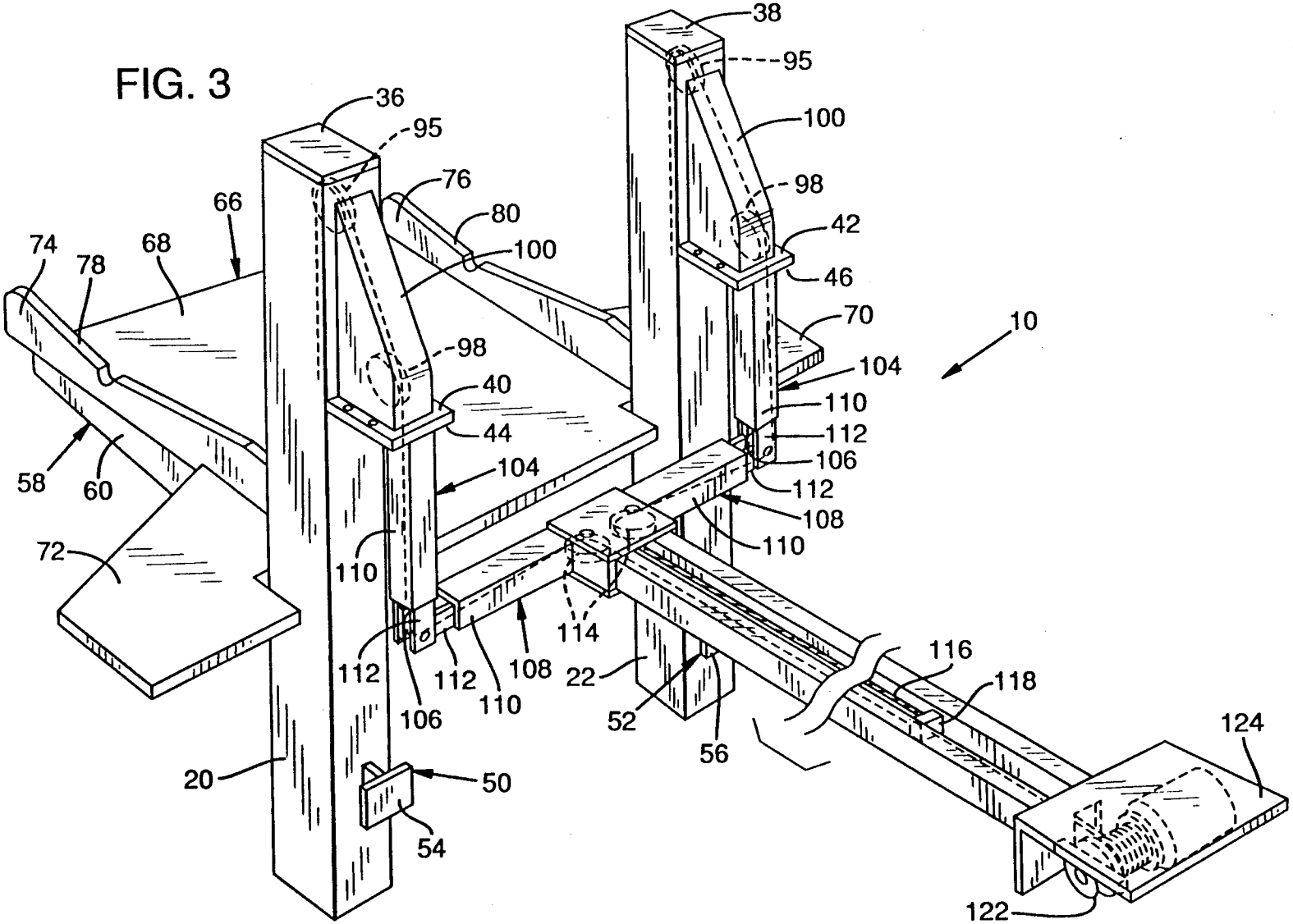
FIG. 3 is a perspective view of the raising and lowering device of FIG. 1 showing cables passing through the cable guide system.

Guide columns 20 and 22 are mounted to reference structure 12 using load bearing mounts 40 and 42, each load bearing mount being fixedly secured to one of the guide columns. As shown in FIG. 3, Load bearing mounts 40 and 42 include load bearing surfaces 44, 46, respectively. As shown in FIG. 1, the load bearing surfaces abut mounting surface 16, each load bearing surface acting as the principal gravitational support for one of the guide columns. Load bearing mounts 40 and 42 are secured to the mounting surface by bolts 48. It is to be understood, however, that the load bearing mounts may be secured to the mounting surface using any known means.

In the depicted embodiment, reference structure 12 also includes an abutment surface 18. Device 10 rests against the abutment surface, rotational movement of the raising and lowering device being restricted thereby. Abutment surface 18 is typically the hull of a boat or the vertical support of a dock or pier. Rotational movement of the invented raising and lowering device is prevented by resting the device against abutment surface 18. Stabilizer mounts 50, 52 are secured to the guide columns, each stabilizer mount having a stabilizing surface 54, 56. The stabilizing surfaces abut abutment surface 18, restricting rotation about the edge of the reference structure. Stabilizer mounts 50 and 52 may simply rest against abutment surface 18 or be secured to the abutment surface by any known means.

Figure 6A:
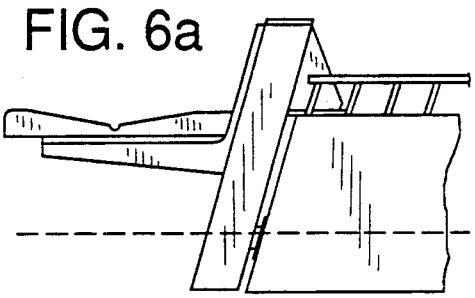
FIG. 6*a* is a side view of the invented raising and lowering device mounted to a boat having a common hull design.
Figure 6B:
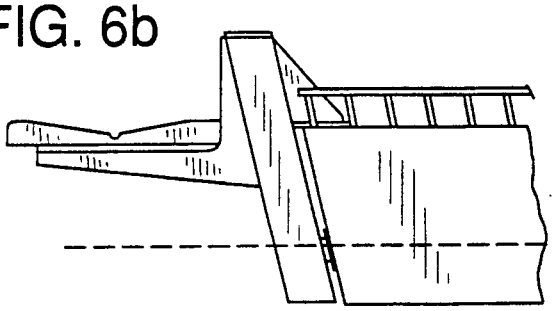
FIG. 6*b* is a side view of the invented raising and lowering device mounted to a boat having another common hull design.

Although FIG. 1 shows stabilizing surfaces 54 and 56 abutting a substantially vertical abutment surface, reference structure designs having various abutment surfaces may be used. FIGS. 6*a* and 6*b* illustrate the invented raising and lowering device mounted on boats having alternative hull designs. Where the abutment surface is not vertical, stabilizing surfaces 54 and 56 may abut the abutment surface at various angles. As depicted, the hulls of these boats are angled, the stabilizing surfaces abutting the hulls at angles. To better accommodate the hull designs shown in FIGS. 6*a* and 6*b*, angled guide columns are used rather than substantially vertical guide columns as depicted in FIG. 1.

The objects which are to be raised or lowered by device 10 rest on a support structure 58. Support structure 58 includes a pair of support arms 60, each support arm being associated with one of the guide columns. A first section 62 of each support arm extends at least partially through slot 30 and into cavity 24. The first section fits closely through the slot, but remains movable along a path defined by the slot. A second section 64 of each support arm extends from first section 62, forming a substantially L-shaped support arm. The support arms may be connected together to form a consolidated support structure or be separate and distinct, each support arm bearing part of the object.

Figure 2:
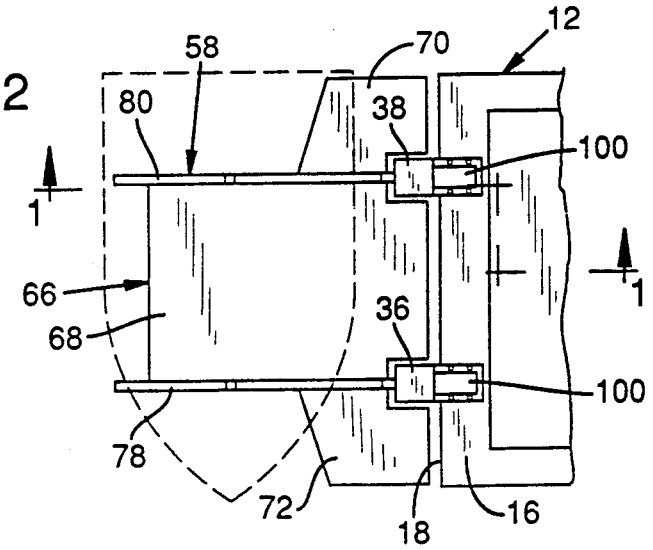
FIG. 2 is a top plan view of the raising and lowering device of FIG. 1.

As shown in FIG. 3, support structure 58 may also include a platform 66, the platform providing an area on which to rest objects which are to be raised and lowered. As shown in FIG. 2, platform 66 includes a central platform section 68, a left platform section 70 and a right platform section 72. The central platform section is secured to the support arms, at least a portion of it extending between the support arms The right and left platform sections are each attached to one of the support arms and extend outwardly therefrom. By raising and lowering the support arms, platform 66 is raised and lowered, the objects resting thereon similarly being raised and lowered.

As shown, a pair of bunk boards 74 and 76 may also be included on device 10. The bunk boards are specifically shaped to fit the contours of the object which is to be raised and lowered. Bunk board 74 and 76 include upwardly facing surfaces 78 and 80, respectively on which the object is positioned.

In the depicted embodiment, device 10 is specifically adapted to raise and lower a dinghy 82 having a contoured undersurface 84. Bunk boards 74 and 76 are shaped such that surfaces 78 and 80 fit against the undersurface of the dinghy when the dinghy rests on the support structure, thus providing a stable seat for the dinghy. It is to be understood that although in the depicted embodiment surfaces 78 and 80 are contoured to abuttingly fit the undersurface of a watercraft, the bunk boards may be shaped to fit the contours of a variety of objects.

Referring now to FIGS. 1 and 4, the first section of each support arm is maintained in a position extending through slot 30 and into cavity 24 using translational elements such as a first roller assembly 86 and a second roller assembly 88, each roller assembly being coupled to the first section at a position within cavity 24. Roller assembly 86 includes a pair of rollers 90 and roller assembly 88 includes a pair of rollers 91. Each pair of rollers is connected together by an axle, such as axle 92 for assembly 86. Axle 92 extends through the first section of support arm 60, a roller being attached at each of its ends. It is to be understood that although the depicted embodiment includes two rollers in each roller assembly, any number of rollers may be used.

As shown in FIG. 1, the first roller assembly is offset from the second roller assembly both vertically and horizontally. The rollers of the first roller assembly rotate along first surface portion 26, each roller abutting one of the sections 32, 34. The rollers of the second roller assembly rotate along opposite surface portion 28. By preventing first section 62 from passing through slot 30, the rollers act to hold support arm 60 in communication with cavity 24. Because the first and second roller assemblies are offset both horizontally and vertically, the rollers of each roller assembly abut oppositely facing surfaces within cavity 24. This serves to keep the first section of each support arm from abutting opposite surface 28 and consequently helps to prevent jamming of the first section within the cavity.

As the roller assemblies move up and down each cavity, support structure 58 is raised and lowered along the guide columns. Support structure 58 is movable from a position well above the water level to a position below the surface of the water. In FIG. 1, the support structure is shown in solid lines at its maximum height above the water, providing for storage of objects above the water level. The lowermost position of the support structure is shown in FIG. 1 by dashed lines, the support structure being low enough for a watercraft to float into position so that it may be raised out of the water.

Support structure 58 is raised and lowered by cables such as cable 93 shown in FIG. 1. Each cable has a first end, such as end 94 on cable 93, which holds one of the support arms, the support arm being raised and lowered as the cable extends and retracts. As shown in FIG. 1, cable end 94 is secured to the first section of one of the support arms and cable 92 remains within cavity 24, protecting the device's users from injury in the event that the cable snaps.

As best indicated by dashed lines in FIG. 3, but as also indicated in FIG. 1, each cable is directed through what may be referred to as a cable conduit assembly. As indicated, the cable conduit assembly includes a series of pulleys. The direction in which the cable extends is changed as it extends around each pulley. Each cable extends up through cavity 24 and around a first pulley 95 which is positioned within the cavity of one of the guide columns. The cable then extends out of the cavity through a hole 96 in the guide column to a second pulley 98. This portion of the cable's path is shielded by a cover member 100. The cable extends around second pulley 98 and down through an aperture 102. The cable extends through a first link 104 to a link joint pulley 106. Upon passing around the link joint pulley, the cable extends through a second link 108. Each link includes an outer frame 110 and an inner frame 112, the inner frame being slidably received within the outer frame in a telescoping arrangement. The length of each link may therefore be adjusted according to the particular requirements of the reference structure and the inner and outer frames joined in any known manner. Upon exiting the second link, the cable extends around a final pulley 114, the cable's second end 116 attaches to a movable cable joint 118.

Where more than one cable is used, each cable extends through a similar series of pulleys and links, attaching to the same cable joint. As cable joint 118 is moved, the cables attached thereto all move uniformly.

An actuator such as cable and winch system 122 is used to move cable joint 118, thereby raising or lowering the support structure. Actuators such as a piston and cylinder combination or a screw jack may alternatively be used to raise and lower the support structure. The actuator is mounted to the reference structure using a mounting bracket 124. In one embodiment of the invention, the actuator may be controlled by a remote device, the extent to which the support structure is raised or lowered being limited using limit switches. The limit switches may be used to cut power to the actuator when the support structure is lowered to a particular position or raised to a particular position.

In an alternative embodiment of the invention, a single cable is used. The cable extends through two sets of pulleys, its first end being secured to the first section of one support arm and its second end being secured to the first section of another support arm. The cable is attached to the cable joint at a position near the center of its length.

Figure 5A:
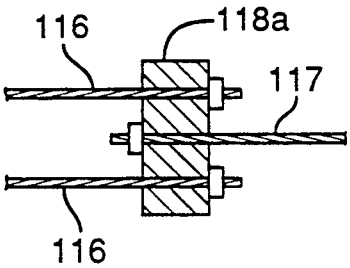
FIG. 5*a* is a sectional view of one embodiment of the cable joint used in the invented raising and lowering device.
Figure 5B:
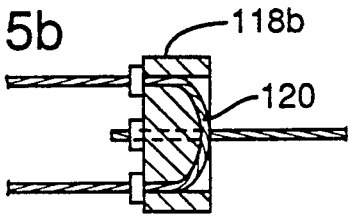
FIG. 5*b* is a sectional view of another embodiment of the cable joint used in the invented raising and lowering device.

In FIGS. 5*a* and 5*b*, alternative embodiments of the cable joint are shown. In the embodiment of FIG. 5*a*, three cables are attached to a cable joint 118*a*, cables 116 are used to hold the support structure and cable 117 extends to the actuator. Where, as in the embodiment of FIG. 5*b*, only one cable holds support structure 58, a central portion 120 wraps around cable joint 118*b*, the cable being secured to the cable joint by any known means.

Figure 7:
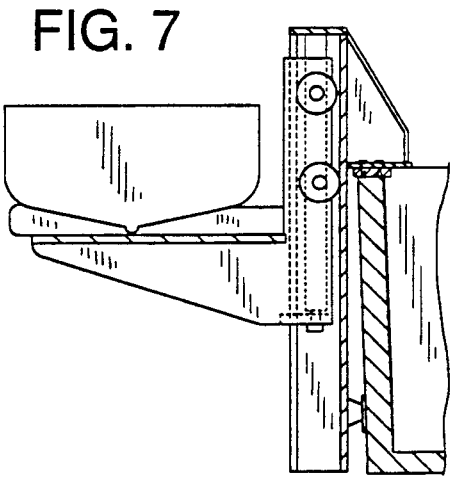
FIG. 7 is a sectional side view of an alternative embodiment of the invented raising and lowering device wherein a piston and cylinder combination raises and lowers the support structure.
Figure 8:
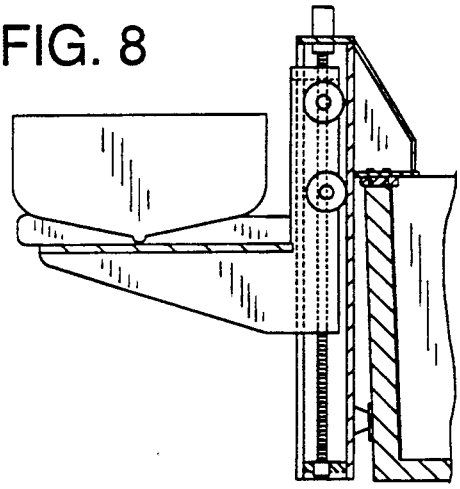
FIG. 8 is a sectional side view of an alternative embodiment of the invented raising and lowering device wherein a screw jack raises and lowers the support structure.

As shown in FIG. 7, in an alternative embodiment of the invention, a piston and cylinder combination may be mounted within each guide column to raise and lower the support structure. In FIG. 8, an embodiment of the invention wherein a screw jack is mounted within each guide column to raise and lower the support structure is shown.

Although preferred embodiments of the invention have been disclosed, it should be appreciated that variations and modifications may be made without departing from the scope of the invention as defined by the claims.

I claim:

1. A device for raising and lowering objects between a reference structure and adjacent water, the device comprising:

a guide column having a cavity and a longitudinal slot allowing access to the cavity;

a raisable and lowerable support structure for bearing the objects, the support structure accessing the guide column cavity through the longitudinal slot;

a cable joint;

a plurality of cables connected to the support structure and to the cable joint;

first and second roller assemblies positioned within the cavity and coupled to the support structure for maintaining the support structure cooperatively adjacent to the guide column while allowing the support structure to move along the length of the slot, where the first roller assembly is positioned to operatively engage a first surface portion of the cavity and the second roller assembly is offset from the first roller assembly to operatively engage an opposite surface portion of the cavity; and an actuator connected to the cable joint for moving the cable joint, which in turn causes the cables to raise and lower the support structure.

2. A device for raising and lowering objects between a boat having a mounting surface and adjacent water, the device comprising:

a guide column having a cavity and a longitudinal slot allowing access to the cavity;

a raisable and lowerable support structure for bearing the objects, the support structure accessing the guide cavity through the longitudinal slot;

a cable joint;

a plurality of cables connected to the support structure and to the cable joint;

a load bearing mount fixedly secured to the guide column, the load bearing mount having a load bearing surface that acts as the principle gravitational support for the guide by resting on the boat's mounting surface;

first and second roller assemblies positioned within the cavity and coupled to the support structure for maintaining the support structure cooperatively adjacent to the guide column while allowing the support structure to move along the length of the slot, where the first roller assembly is positioned to operatively engage a first surface portion of the cavity and the second roller assembly is offset from the first roller assembly to operatively engage an opposite surface portion of the cavity; and an actuator connected to the cable joint for moving the cable joint, which in turn causes the cables to raise and lower the support structure.

3. A device for raising and lowering objects between a reference structure and adjacent water, the device comprising:

a guide column having a cavity and a longitudinal slot allowing access to the cavity;

a movable support structure for bearing the objects, where the support structure has a first section extending through the slot and into the cavity;

first and second roller assemblies positioned within the cavity and coupled to the support structure's first section for retaining the first section within the cavity while allowing the support structure to move along the length of the slot, where the first roller assembly is positioned to operatively engage a first surface portion of the cavity and the second roller assembly is offset from the first roller assembly to operatively engage an opposite surface portion of the cavity; and an actuator to raise and lower the support structure.

4. The device of claim 3 where the reference structure is a boat having a mounting surface, the device further comprising:

a load bearing mount fixedly secured to the guide column and having a load bearing surface that acts as the principle gravitational support for the guide column by resting on the boat's mounting surface.

5. The device of claim 3 wherein the support structure further comprises a surface shaped to fit the contoured undersurface of a watercraft.

6. A device for raising and lowering objects between a reference structure and adjacent water, where the device is mounted to a boat having a mounting surface, the device comprising:

a movable support structure for bearing the objects;

two spaced-apart guide columns, each guide column having a cavity and a longitudinal slot allowing the support structure to access the cavity;

first and second roller assemblies positioned within the cavity of each guide column and coupled to the support structure for maintaining the support structure cooperatively adjacent to the guide columns while allowing the support structure to move along the length of the slots, each first roller assembly positioned to rotatably engage a first surface portion of the cavity of each guide column and each second roller assembly transversely offset from the first roller assembly to rotatably engage an opposite surface portion of the cavity of each guide column;

a load bearing mount fixedly secured to the guide column and having a load bearing surface that acts as the principle gravitational support for the device by resting on the boat's mounting surface;

a cable joint:

a cable guide system, having a plurality of pivotable links coupled together at link joints, where each link joint has a guide pulley;

two cables, each cable passing through the cable guide system and having a first end connected to the support structure and a second end connected to the cable joint; and an actuator connected to the cable joint for moving the cable joint, which in turn causes the cables to raise and lower the support structure.

7. A device for raising and lowering objects between a reference structure and adjacent water, the device comprising:

a guide column having a cavity and a longitudinal slot allowing axis to the cavity;

a movable support structure for bearing the objects, the support structure having a first section extending through the slot and into the cavity;

first and second translational elements positioned within the cavity and coupled to the support structure's first section for retaining the first section within the cavity while allowing the support structure to move along the length of the slot, where the first translational element is positioned to operatively engage a first surface portion of the cavity and the second translational element is offset from the first translational element to operatively engage an opposite surface of the cavity; and an actuator to raise and lower the support structure.

8. The device of claim 7 wherein the translational elements are roller assemblies.

* * * * *